United States Patent [19]

Nagano et al.

[11] 4,307,128

[45] Dec. 22, 1981

[54] METALLIC COATING METHOD USING ULTRASONIC VIBRATION

[75] Inventors: Kentaro Nagano; Toru Iseda, both of Yokohama, Japan

[73] Assignee: Asahi Glass Company, Ltd., Tokyo, Japan

[21] Appl. No.: 73,558

[22] Filed: Sep. 7, 1979

Related U.S. Application Data

[63] Continuation of Ser. No. 921,709, Jul. 3, 1978, abandoned, which is a continuation of Ser. No. 816,710, Jul. 18, 1977, abandoned.

[30] Foreign Application Priority Data

Jul. 30, 1976 [JP] Japan ..... 51-90218

[51] Int. Cl.[3] ..... B05D 3/12

[52] U.S. Cl. ..... 427/57

[58] Field of Search ..... 427/57

[56] References Cited

FOREIGN PATENT DOCUMENTS 846961 6/1961 United Kingdom .

*Primary Examiner*—Bernard D. Pianalto

*Attorney, Agent, or Firm*—Oblon, Fisher, Spivak, McClelland & Maier

[57] ABSTRACT

A metallic coating method is carried out by contacting a surface of a substrate with a molten metal which is locally raised under ultrasonic vibration. A metallic coating can be continuously attained on one side only of ribbon type substrate in a form of plate, sheet or strip or only the outer surface of a pipe.

8 Claims, 5 Drawing Figures

METALLIC COATING METHOD USING ULTRASONIC VIBRATION

This is a continuation, of application Ser. No. 921,709, filed July 3, 1978 which is a continuation of application Ser. No. 816,710 filed July 18, 1977 both abandoned.

BACKGROUND OF THE INVENTION

1. Field of the Invention

The present invention relates to a metallic coating method using ultrasonic vibrational energy. More particularly, it relates to a metallic coating method of coating a ribbon type substrate in a form of plate, sheet or strip of metal on one side only or a pipe on outer surface only or a curved surface of the substrate with a molten metal.

2. Description of the Prior Art

The metallic coating method by immersing a sheet or strip of metal in a molten metal which is called as hot dipping process has been applied in various fields as it has been found in the processes for preparing a galvanized sheet or a tin plate.

In the conventional hot dipping processes, both sides for plating such as a sheet metal have been dipped in a molten metal bath. Accordingly, they have been suitable for metallic coating of both sides of the sheet metal. However, when the metallic coating is applied on one side surface of a sheet metal especially a thin sheet, it is required to contact the one surface for metallic coating with the molten metal bath but to prevent the contact of the other surface with the molten metal bath by coating the surface with a masking material.

Because of the difficulty of the operation and the removal of the masking material after the metallic coating, suitable hot dipping process has not been found as a metallic coating method of sheet material on one side only.

SUMMARY OF THE INVENTION

It is an object of the present invention to provide a novel metallic coating method of coating a ribbon type substrate such as plate, sheet or strip on one side only with a molten metal.

It is another object of the present invention to provide a metallic coating method of coating a pipe on outer surface only with a molten metal.

It is the other object of the present invention to provide a metallic coating method of coating a surface of a plate on localized area only or a bending surface with a molten metal.

The foregoing and other objects of the present invention can be attained by contacting a surface of a substrate for metallic coating, with a molten metal which is locally raised by ultrasonic vibration energy.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
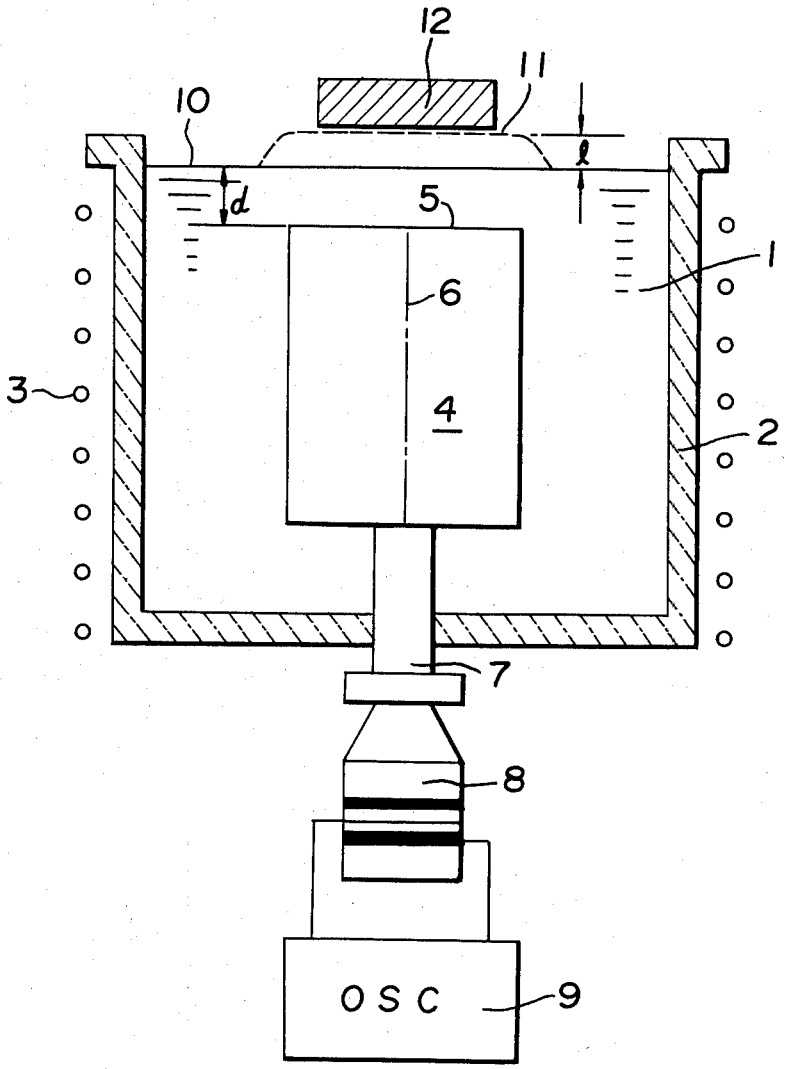
FIG. 1 is a schematic sectional view for illustrating the metallic coating method of the present invention.

Referring to the drawings, the metallic coating method of the present invention will be illustrated.

In FIG. 1, the reference numeral (1) designates a molten metal bath; (2) designates a molten metal vessel for the molten metal bath; (3) designates a heater for melting a metal which is disposed around the bath (1); (4) designates an ultrasonic resonance tool (hereinafter referring to as tool) which imparts ultrasonic vibration energy to the molten metal bath in it; (5) designates a free edge of the tool (4) and (6) designates a center line for the tool (4). A horn (7) for transferring the ultrasonic vibration is connected to the tool (4) and an ultrasonic transducer (8) is connected to the opposite end of the horn. The reference numeral (9) designates a high frequency electronic oscillator as the ultrasonic vibration source; (10) designates a surface of the molten metal bath when no ultrasonic vibration is imparted; (11) designates the molten metal surface which is locally raised by imparting ultrasonic vibration; and (12) designates a substrate to which the metallic coating is applied.

In the operation of the present invention, the tool (4) is dipped into the bath (1) to give the center line (6) of the tool (4) to substantially perpendicular to the molten metal surface (10). After dipping the tool (4) ultrasonic vibration is imparted to the tool (4). The space between the molten metal surface (10) and the free edge (5) is adjusted to raise the molten metal surface above the free edge (5) as shown by the dotted line to form the raised molten metal surface (11). The gap l is caused between the level of the raised molten metal surface (11) and the level of the molten metal surface (10) (except the part above the free edge (5)) which is not raised by the ultrasonic vibration.

When the tool (4) is dipped in the bath below the molten metal surface (10) at a depth of 1 mm and the ultrasonic vibration of 20 KHz is applied to the molten metal bath (1), the molten metal surface (11) is raised for 2 mm. Usually, the gap l between the molten metal surface (10) and the raised molten metal surface (11) can be adjusted by the input to the ultrasonic transducer and the distance d between the raised molten metal surface (11) and the free edge.

In the method of the present invention, the formation of the gap l is important. Evenso, the height of gap l is not critical and can be less than 4 mm though a higher gap is preferable. The distance d between the molten metal surface (10) and the free edge (5) is preferably 0 to 5 mm when the free edge (5) is dipped in the molten metal bath. When the distance d is more than 5 mm, the ultrasonic vibration energy is attenuated to allow for remarkably small raising of the molten metal surface. When the free edge (5) is exposed above the molten metal bath (10), the distance d is preferably 0 to 3 mm.

The raised molten metal surface (11) which is raised about 1 mm above the free edge (5) is formed by covering the free edge of the tool (4) with the molten metal by the ultrasonic vibration when the distance d is in said range. When the distance d is more than 3 mm, the molten metal is not raised to cover the free edge of the tool (4) by the ultrasonic vibration and, as a result the raised molten metal surface (11) is not formed on the free edge.

The shape of the raised molten metal surface (11) substantially corresponds to the free edge surface of the tool (4). When the free edge has round shape, the molten metal surface is raised in a round shape. When the free edge has a rectangular shape, the molten metal surface is raised in a rectangular shape. The raised molten metal surface having a desired shape (11) can be formed by selecting the shape and the size of the free edge.

When the free edge is a flat surface, the raised surface is the flat surface. When a concave surface is formed on a free edge, the molten metal surface corresponding to the concave is not raised whereby the local metallic coating can be attained.

Figure 2:
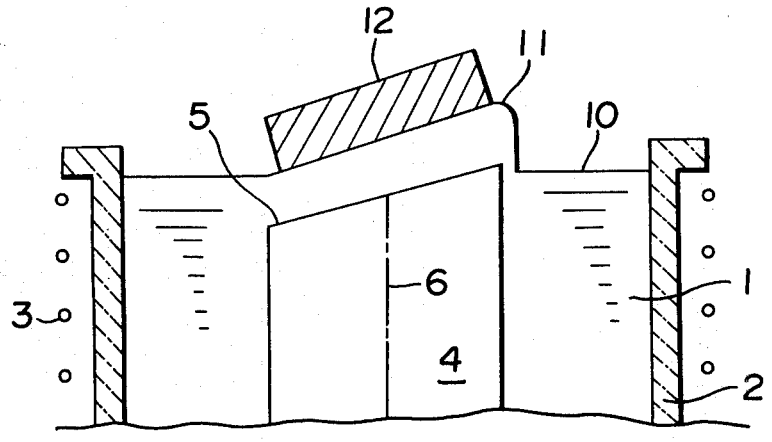
FIG. 2 is a schematic sectional view for illustrating the metallic coating method using an ultrasonic vibration tool.

When the tool with a free edge having slant free edge is used as shown in FIG. 2, and the ultrasonic vibration is imparted by maintaining the central line (6) of the tool (4) to substantially perpendicular to the molten metal surface (10), a raised molten surface (11) which is raised substantially parallel to the slant free edge (5) can be formed.

When a substrate (12) such as a sheet, a silicon wafer etc. is contacted to the slant raised molten surface (11), the bubbles formed during the metallic coating are easily removed to prevent the accumulation of bubbles without shifting the substrate (12).

One embodiment of the present invention for metallic coating to the substrate such as a sheet or a pipe will now be discussed in detail.

When the metallic coating is applied on one surface only of a sheet made of steel or glass and the specific gravity of the sheet is higher than the specific gravity of the molten metal bath, it is especially effective to prevent the coating of the molten metal on the upper surface of the sheet by maintaining the shape of the raised molten surface slightly smaller than the shape of the sheet (such as 0.5 to 1.5 mm smaller).

Figure 3:
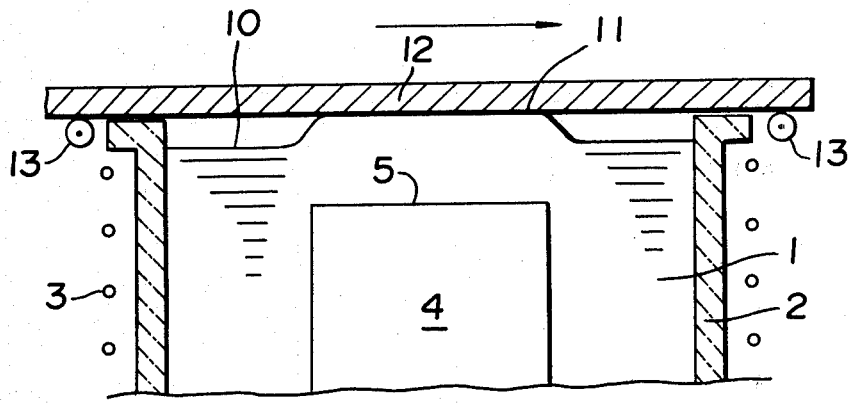
FIGS. 3 and 4 are respectively, schematic sectional views for illustrating the metallic coating on one side only of a sheet or outer surface of a pipe.

It is possible to contact the lower surface of the sheet with the raised molten metal surface (11) by disposing holding rollers (13) at both sides of the molten metal vessel (2) as shown in FIG. 3. In the latter case, the shape of the raised molten metal surface (11) can be broader than the shape of the sheet.

When the substrate for metallic coating such as a sheet of steel which is degreased and cleaned by the conventional processes is contacted with the raised molten metal surface, the contacted surface of the substrate is rapidly wetted with the molten metal by imparting ultrasonic vibration whereby the metallic coating is rapidly attained. When the shape of the raised molten metal surface is smaller than the shape of the substrate or the substrate is floated on the holding rollers, the metallic coating on one side only can be easily attained without coating or staining the upper surface of the substrate.

The substrate can be raised to upper direction after the metallic coating. Thus, in order to obtain smooth metallic coated surface, it is preferable to shift the substrate in parallel to the molten metal surface and to separate the substrate from the raised molten metal surface. Thus, it is unnecessary to incline the substrate nor to bend the substrate for taking up from the molten metal vessel and the molten metal does not coat the upper surface of the substrate even though it is a thin sheet, because the gap between the surface of the molten metal bath and the raised molten metal surface is given.

Figure 4:
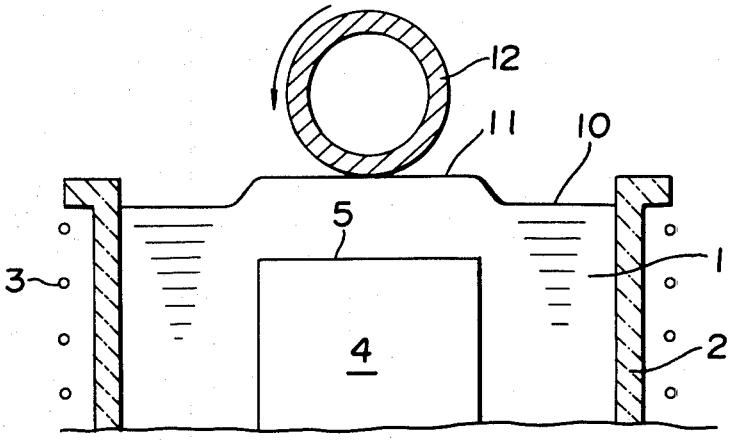

When the hot dip coating is applied on the outer surface only of a cylindrical substrate (13) such as a pipe, the outer surface of the pipe is contacted with the raised molten metal surface formed by imparting the ultrasonic vibration as shown in FIG. 4 and the pipe is turned around the central axis of the pipe or is shifted to the central axial direction. When the pipe is turned around the central axis, all of the outer surface of the pipe can be coated. When the pipe is shifted to the central axial direction, the outer surface of the pipe parallel to the central axis is coated.

When it is necessary to increase the area of the raised molten metal surface so as to correspond to the size of the substrate, it is possible to use a plurality of ultrasonic transducers (8) connected to the rear end of the tool (4) having a large size free edge. The area and shape of the raised molten metal surface are not critical and can be selected as desirable.

Usually, the length of the tool is preferably $\frac{1}{2}\lambda$ or an integer thereof wherein $\lambda$ represent wavelength, so as to vibrate the free edge in the maximum amplitude. The length of the horn 7 connected to the tool is preferably $\frac{1}{2}\lambda$ or an integer thereof. In this case, the connecting point between the tool and the horn has the maximum amplitude so as to effectively transfer the ultrasonic vibration energy to the tool.

The width of the tool for imparting the uniform vibration by one ultrasonic transducer is dependent upon the material and is less than $\frac{1}{3}$ of the wavelength $\lambda$ of the ultrasonic vibration transferring the tool.

When the hot dip coating is applied on the ribbon type substrate having broader width as compared with the wavelength, a plurality of horns are connected to the tool having a free edge equal to the width of the ribbon with $\frac{1}{3}$ to $\frac{1}{4}$ of the wavelength of the ultrasonic vibration transferred to the tool, and the ultrasonic transducers are respectively connected to the horns.

When the horns are connected symmetrically with respect to the center line in width of the tool, a uniform ultrasonic vibration is imparted in whole range of the width of the tool.

A plurality of tools connected with one or more transducers can be dipped in the bath and the ultrasonic vibration is transferred to the tools to raise the molten metal surface.

When the molten metal bath or the substrate is made of a metal which is easily oxidized, the metallic coating method is carried out in an inert atmosphere such as nitrogen gas, a mixed gas of nitrogen and hydrogen, argon gas or helium for preventing the oxidation.

The tool made of carbon steel or stainless steel has been used from the viewpoints of processability, high propagation of ultrasonic vibration and uniform spreading. When zinc or the specific alloy containing zinc which can be coated on an oxide or a metal having oxide film is used, the tool is corroded by the molten metal because of cavitation caused by a ultrasonic vibration. Accordingly, it is preferable to use the tool made of molybdenum, tantalum tungsten, niobium or alloys thereof whereby the corrosion of the tool by the molten metal can be substantially prevented.

The composition of the molten metal bath used in the method of the present invention is not critical and can be Al type, Pb type, Sn type or Zn type metal or the alloy thereof.

In order to attain the metallic coating without a flux to a substrate to which the metallic coating is not easily attained with a molten metal, such as glass, ceramics or oxides, it is preferable to use Pb-Sn-Zn type solder or Pb-Sn-rare earth element solder or the Zn-Sn type solder so as to attain a metallic coating with good adhesion to the substrate.

The former solder alloys comprise Pb and Sn as main components and 0.05 to 30 wt.% of Zn and/or 0.1 to 15 wt.% of rare earth element especially the solder alloys comprise 2 to 98.5 wt.% of Pb; 1 to 97.5 wt.% of Sn, 0.05 to 30 wt.% of Zn and/or 0.1 to 15 wt.% of rare earth element and less than 15 wt.% of Sb.

In order to prevent the formation of scale of the molten metal, 0.01 to 0.1 wt.% of Al can be incorporated in the molten metal. In order to keep brightness of the metallic coated surface, a small amount of Si, Ti or Be or a mixture thereof at a ratio of less than 0.5 wt.% can be incorporated.

The Zn-Sn type solder alloys comprise 15 to 98 wt.% of Zn; 82 to 2 wt.% of Sn; 0.01 to 0.5 wt.% of Al and less than 5 wt.% of Ag.

The substrates used in the method of the present invention can be metals for metallic coating with a flux by the hot dipping process as well as glass, ceramics or pottery, solid oxides such as natural or artificial minerals; and metals having oxide film such as silicon, germanium, aluminum, titanium, zirconium, or tantalum etc.

The ultrasonic vibration energy is not critical and is usually 1 to 100 watt/cm$^2$ preferably 5 to 30 watt/cm$^2$ as input.

As described above, in accordance with the method of the present invention, the metallic coating on only one surface can be attained without a flux by the ultrasonic vibration to the metals which have been coated by the conventional hot dipping process without applying the ultrasonic vibration, and also the substrates which could not be coated by the conventional hot dipping process.

The following examples are given solely to illustrate the present invention in detail.

EXAMPLE 1

A molten solder bath consisting of 90.932 wt.% of Pb, 4.77 wt.% of Sn, 1.36 wt.% of Sb, 0.008 wt.% of Si, 0.01% of Ti and 0.02 wt.% of Al was heated at 330° C.±5° C. As shown in FIG. 1, a molybdenum tool for ultrasonic vibration having a free edge (20 mm×20 mm) was disposed below the molten solder surface in a depth of 1 mm in substantially parallel to the molten solder surface.

The ultrasonic vibration having 20 KHz was applied to the tool to maintain a condition raising the molten solder surface in a round shape having a diameter of about 25 mm in a height of 2 mm above the tool. An alumina sheet having a size of 21 m×21 mm and a thickness of 0.8 mm was contacted with the raised molten solder surface and was departed from it by shifting the plate in a parallel direction.

The smooth metallic coating having a thickness of 30μ was uniformly adhered on the lower surface of the alumina sheet.

According to an adhesion test using a razor, confirmation was made of resulting excellent adhesion. The upper surface of the alumina sheet was not stained with the molten solder and excellent metallic coating on only one side only was attained.

The free edge of the tool was disposed below the molten solder surface (10) in a depth of 8 mm. The lower surface of the alumina sheet was contacted with the molten solder surface above the free edge of the tool and the metallic coating was carried out under the same condition of the ultrasonic vibration. In the latter case, the molten solder surface above the free edge of the tool was not raised.

When the alumina sheet was contacted with the molten solder surface, the molten solder was moved on the peripheral part of the upper surface of the alumina sheet to coat it. When it was taken out after 5 seconds, about 40% of the upper surface was coated with the molten solder.

The metallic coating on the lower surface had high adhesion, however the thickness of the metallic coating layer was not uniform and fluctuated in the range of 18 to 50μ, because it was obliged to be taken out at a slant.

The adhesion test was carried out by shaving a coated layer with a knife or a razor so as to test the adhesion of the coated layer.

EXAMPLE 2

In the molten solder bath having the composition of Example 1, a molybdenium tool for ultrasonic vibration having a width of 85 mm and a thickness of 20 mm was disposed below the molten solder surface in a depth of 1.5 mm.

The ultrasonic vibration having 20 KHz was applied to the tool whereby the molten solder surface was raised in a shape of a width of 85 mm, a length of 21 mm and a height of 2 mm.

A soda-lime silica glass (float glass) ribbon having a thickness of 3 mm and a width of 85 mm which was preheated at 200° C. was shifted on the rollers as shown in FIG. 3 under contacting it with the raised molten solder surface at a speed of 3.5 cm/sec. in the arrow line direction.

The lower surface of the glass ribbon was coated with the solder having the same composition to form a metallic coating having a mirror surface and a thickness of 20μ, and having good adherence. No stain was found on the upper surface of the glass ribbon.

EXAMPLE 3

A molten metal bath consisting of 99.6 wt.% of Zn, 0.2 wt.% of Pb, and 0.2 wt.% of Al was heated at 470° C.±5° C.

The tool of Example 2 was disposed below the molten metal surface to form a raised molten metal surface having a width of 85 mm, a length of 21 mm, and a height of 3 mm.

A lower carbon steel strip having a thickness of 0.7 mm and a width of 87 mm was treated by degreasing-pickling in acid-water-rinsing-drying steps. In accordance with the process of Example 2, the metallic coating was carried out.

A metallic coating having a thickness of 20μ was formed on the lower surface of the steel strip contacted with the raised molten metal surface. An alloy layer was formed between the steel and the metallic coating.

The molten metal was not spread on the upper surface from both edges of the steel strip during the operation and excellent metallic coating on one side only could be attained.

The steel strip having metallic coating was repeatedly bent by the 180 degree bending test until breaking it, however, the metallic coating was not peeled off.

EXAMPLE 4

In accordance with the process of Example 2 using the same molten solder bath and the same tool, only the outer surface of a porcelain tube was coated with the metallic coating.

A porcelain tube having an outer diameter of 20 mm and an inner diameter of 17 mm and a length of 86 mm was used.

The porcelain tube, which was preheated at 300° C., was contacted with the raised molten solder surface as shown in FIG. 4 and was turned by a holder (not shown) at a peripheral speed of 3 cm/sec. in the direction of the arrow. After turning it for one turn, the porcelain tube was shifted in the transverse direction so as to depart from the raised molten solder surface. As the result, the outer surface of the porcelain tube was coated with a uniform metallic coating having a thickness of 20μ. No stain of the molten solder was found on the inner surface of the porcelain tube.

According to the adhesion test, it was confirmed that the solder layer had excellent adherence.

EXAMPLE 5

The same composition of the molten metal bath and same temperature of the bath of Example 3 were used in this Example.

Figure 5:
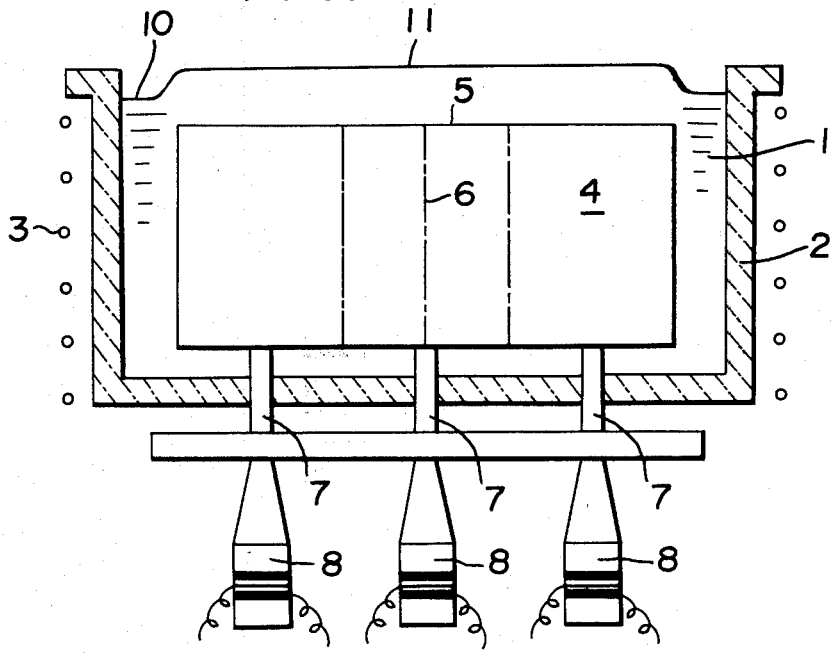
FIG. 5 is a schematic sectional view for illustrating the metallic coating method connecting a plurality of ultrasonic transducers to an ultrasonic vibration tool.

A molybdenum tool for ultrasonic vibration which has a free edge having a width of 170 mm and a thickness of 20 mm was used. The free edge of the tool could not be uniformly vibrated with one ultrasonic transducer. Accordingly, the free edge of the tool was uniformly vibrated with two ultrasonic transducers as shown in FIG. 5 (three ultrasonic transducers are used in FIG. 5). Ultrasonic vibration having 20 KHz was applied. The distance between the free edge and the molten metal surface was 1 mm and the ultrasonic vibration was applied while controlling the output of the oscillator so as to form a raised molten metal surface having a height of 2 mm.

A low carbon steel pipe having an outer diameter of 18 mm and an inner diameter of 15 mm was treated by degreasing-pickling in acid-water-rinsing-drying steps.

The outer surface of the pipe was contacted with the raised molten metal under the above-mentioned condition as shown in FIG. 4 and was turned at a peripheral speed of 3 cm/sec. After turning it for one turn, the pipe was shifted in the transverse direction so as to depart from the raised molten metal surface. As the result, the outer surface of the pipe was coated with a metallic coating having a thickness of 15 to 18μ. An alloy layer was formed between the pipe and the metallic coating.

According to the adhesion test, it was confirmed that the metallic coating layer had excellent adherence.

EXAMPLE 6

A molten alloy bath consisting of 76.98 wt.% of Zn, 22.0 wt.% of Sn and 0.02 wt.% of Al was heated at 450° C.±5° C.

As shown in FIG. 2, the free edge of the molybdenum tool for ultrasonic vibration having a diameter of 25 mm was shaved to have a slant angle of 7 degrees to the molten alloy surface. The distances from the molten alloy surface to both of the free edges were respectively maintained to 2 mm and −2 mm, and ultrasonic vibration of 20 KHz was applied (symbol of—means to expose on the molten alloy surface). When the free edge of the tool is slanted, the higher free edge (right) is exposed by 2 mm and the lower free edge (left) is dipped 2 mm in the case of no ultrasonic vibration. When the ultrasonic vibration is applied, a rise in the slant bath surface is formed.

The raised molten alloy surface had a height of 3 mm above the highest free edge and a height of 0.5 mm above the lower free edge to provided a slant molten alloy surface.

A silicon wafer having a diameter of 25.4 mm and a thickness of 0.3 mm was contacted with the raised molten alloy surface for 5 seconds, and then, it was taken up by shifting it along the slant surface.

A metallic coating having a thickness of 20μ was formed on the lower surface of the silicon wafer contacted with the raised molten alloy surface and no bubble was found. According to the adhesion test, the metallic coating had excellent adherence. During the metallic coating operation for the lower surface, the molten alloy was not spread on the upper surface and excellent metallic coating on one side only could be attained.

Obviously, numerous modifications and variations of the present invention are possible in light of the above teachings. It is therefore to be understood that within the scope of the appended claims, the invention may be practiced otherwise than as specifically described herein.

What is claimed is:

1. A one sided surface metallic coating method wherein said ribbon strip metal is steel and said molten metal is an alloy of zinc as the main component and with 0.01 to 0.5 wt.% of Al.

2. A one sided surface metallic coating method according to claim 1 including applying 1 to 100 Watt/cm$^2$ of ultrasonic vibration energy to the free edge of the tool.

3. A one sided surface metallic coating method according to claim 2 wherein said tool comprises molybdenum, tungsten niobium, tantalum or these alloys.

4. A one sided surface metallic coating method according to claim 3 wherein said tool is connected to a plurality of ultrasonic transducers to uniformly vibrate the free edge of said tool.

5. A one sided surface metallic coating method according to claim 4 wherein a length of said tool is $\frac{1}{2}\lambda$ or an integer of $\frac{1}{2}\lambda$ wherein $\lambda$ represents ultrasonic wavelength.

6. A one sided surface metallic coating method according to claim 5 wherein said tool is connected to a plurality of ultrasonic transducers in a space of $\frac{1}{3}$ to $\frac{1}{4}$ of the ultrasonic wavelength.

7. The method according to claim 1 wherein the molten metal bath is kept in an inert atmosphere for preventing oxidation.

8. A method of coating a continuous ribbon strip metal on one-sided surface only with a homogeneous metallic coating, which comprises the steps of:

advancing said ribbon strip above a surface of a molten metal bath;

placing a tool having a free edge for ultrasonic vibration in said molten metal bath;

maintaining the vertical position of the free edge at or above the surface of the molten metal bath not higher than 3 mm when no ultrasonic vibration is applied to the tool;

supporting the ribbon strip metal at a predetermined elevation relative to the surface of the molten metal bath to prevent the molten metal from contacting the upper-sided surface of the ribbon strip metal, while vibrationally contacting continuously an entire undersided surface only of said ribbon strip metal over the whole width with said raised surface of the molten metal bath, thereby coating said entire under-sided surface only of the ribbon strip metal with a homogeneous metallic coating.

* * * * *